US005496454A

United States Patent [19]

Ishibashi et al.

[11] Patent Number: 5,496,454

[45] Date of Patent: Mar. 5, 1996

[54] METHOD FOR THE OPERATION OF ELECTROLYTIC BATHS TO PRODUCE $FE_3O_4$ ELECTROPHORETICALLY IN A THREE COMPARTMENT CELL

[75] Inventors: Tadaya Ishibashi, Suita; Hideto Obara; Satoshi Taue, both of Uji, all of Japan

[73] Assignee: Unitika Ltd., Hyogo, Japan

[21] Appl. No.: 341,444

[22] Filed: Nov. 16, 1994

Related U.S. Application Data

[63] Continuation of Ser. No. 107,290, Aug. 16, 1993, abandoned.

[30] Foreign Application Priority Data

Aug. 21, 1992 [JP] Japan ..... 4-221856

[51] Int. Cl.[6] ..... C25B 7/00; C25B 1/00

[52] U.S. Cl. ..... 204/520

[58] Field of Search ..... 204/182.4, 182.5, 204/105 R, 96, 112, 113, 114, 115, 105 M

[56] References Cited

U.S. PATENT DOCUMENTS

| | | | |
|---|---|---|---|
| 3,394,068 | 7/1968 | Calmon et al. | 204/301 |
| 4,008,076 | 2/1977 | Junghanss et al. | 204/108 |
| 4,234,393 | 11/1980 | Hepworth et al. | 204/105 R |
| 4,948,489 | 8/1990 | Greenberg | 204/228 |

FOREIGN PATENT DOCUMENTS

| | | | |
|---|---|---|---|
| 0623339 | 7/1961 | Canada | 204/96 |
| 75882 | 7/1983 | European Pat. Off. . | |
| 507006 | 10/1992 | European Pat. Off. . | |
| 2404558 | 3/1978 | Germany . | |
| 3618769 | 7/1987 | Germany . | |

*Primary Examiner*—Kathryn Gorgos

*Attorney, Agent, or Firm*—Barnes, Kisselle, Raisch, Choate, Whittemore & Hulbert

[57] ABSTRACT

A method for the operation of electrolytic baths whereby a charged, dissociative metal cationic solute which dissolves in a solution such as treatment used for a metal surface acid-washing, is separated and migrated through the diaphragm of an ion-selective separatory membrane. The cathode chamber solution contains as the electrolyte maintaining the basic electrical conductivity, a salt containing ammonium and at least one of sodium or potassium ions as the cation, and a salt containing a chloric ion or both a chloric ion and a sulfuric ion, but no nitric ion, as the anions. Furthermore, as the regulator which maintains the alkalinity in response to the progress of the electrolysis process, the cathode chamber solution contains at least one of an ammonium salt, a carbonate or a carboxylate. By this, metal oxide particles or metal particles are separated and produced in the circulated cathode chamber solution.

6 Claims, 2 Drawing Sheets

METHOD FOR THE OPERATION OF ELECTROLYTIC BATHS TO PRODUCE $FE_3O_4$ ELECTROPHORETICALLY IN A THREE COMPARTMENT CELL

"This is a continuation of application(s) Ser. No. 08/107,290 filed on Aug. 16, 1993, now abandoned".

FIELD OF THE INVENTION

The present invention relates to a method for the operation of electrolytic baths whereby a charged, dissociative metal cationic solute which dissolves in a solution such as an acid-wash used for metal surface treatment, is separated by migration through the diaphragm of an ion-selective separatory membrane.

BACKGROUND OF THE INVENTION

Japanese Unexamined Published Patent Application No. 4- 304393 and Japanese Unexamined Published Patent Application No. 4- 354890, have already given a description regarding a method wherein impurities in a supplied electrolyte solution are removed, for the purification of waste solution which accompany industrial production. In this method, an electrolytic bath is used which includes an ion-selective diaphragm between an anode and a cathode, the electrolyte solution to be electrolyzed is supplied in the area between the anode and the diaphragm (hereunder referred to as "anode chamber"), the cationic metal ion contained in the electrolyte solution is subjected to electrophoresis towards the cathode end through the diaphragm for separation, and the matter separated into a cathode chamber with the cathode provided therein is separated using some sort of separating apparatus.

If the anode chamber solution, which is supplied to the anode chamber in a circulatory manner, can be controlled so that the separated matter is converted into a more usable form upon separation, then a major contribution will have been made to the industrial field.

If a cation-selective membrane is employed as the diaphragm, then usually the free acid radical is separated into the anode chamber, while the anionic metal ion is converted into the hydroxide form of the metal by the alkalinity generated by charging and dissociation of the water, and thus a glutinous, dark-green, amorphous matter is produced in the cathode chamber. However, no effective method has been discovered for controlling, as desired, the properties of the matter produced in this manner.

Also, it is publicly known that viscous hydroxides are produced in the cathode chamber, and regarding given metal ion species, it is known that reducing metal, particles of indefinite diameter are obtained on the cathode surface. Nevertheless, the production has not been realized for a wider range of metal species in the cathode chamber.

Measures for the prevention of environmental pollution have been applied for years. However, at the same time, waste matter has been generated as a secondary product of these preventive measures, for which no utility value has been found, and the disposal of this waste matter has become a problem. In other words, it has been believed that the production of waste matter in environmental pollution prevention measures is unavoidable.

SUMMARY OF THE INVENTION

The object of the present invention is to overcome the above problems, and convert a wide range of metal species, including polluting substances and the like, into a form having effective properties with utility value.

The present applicants have discovered that the properties of matter contained in solutions to be subjected to electrolysis which is to be removed therefrom and separated from the desired product, may be converted to a considerable degree depending on the conditions of the environment in the cathode chamber. That is, we, the present applicants, discovered that the difference in electrode materials and the shape of construction of the electrodes in the electrolytic bath used for separation have little influence on the properties to be imparted to the separated object matter. Furthermore, we recognized that by adjusting the composition making up the electrolyte solution filling the cathode chamber and the method of control of the operation controlling conditions, it is possible to control the properties of the resulting separated matter in the cathode chamber. Thus, it is also possible to procure the funds to offset the energy costs necessary for the separation process, by separating the metal ion component which accumulates in the solution to be electrolyzed due to the electrolytic separation process, in an effectively usable form in order to increase the additive value thereof, and through the development of applications therefor and the improvement of their utility value.

To overcome these problems, we applied the fact that usually a reduction reaction is carried out through electrons on a cathode surface. The solution around the cathode surface exhibits alkalinity, and therefore, the metal ion species is generally produced at this location in the form of a hydroxide. By controlling the progress of the reaction and the size of the separated matter, the oxidation of the separated matter may be further promoted, converted into a form such as triiron tetraoxide, etc., and depending on the ion species, the separated matter may be reduced to the form of a metallic powder. Thus, since the separated matter is chemically stabilized into an insoluble state, the inclusion of impurities is avoided, and the substance may be converted into a more highly pure compound.

Furthermore, by maintaining the control of the composition of the cathode chamber solution to preferred conditions, control is also possible in such a manner that the resulting separated matter has a particle diameter with excellent uniformity, with particles which are very small and whose particle size distribution is narrow, and further whose particle size distribution curve is an ideal Gauss distribution with bilateral symmetry. Also, upon comparison of the composition ratio of electrolytes contained in the solution to be electrolyzed with the composition ratio making up the matter separated into the cathode chamber, it is clear that the precipitation behavior differs considerably depending on the metal species, and therefore, it is expected that the process of purification and the process of uniform mixing and precipitation may be effected simultaneously.

DETAILED DESCRIPTION OF THE INVENTION

The novel aspect presented by the present invention is the effective use of the properties of ion species which are dispersed into a cathode chamber, by considerably modifying the composition of the cathode chamber solution in an electrolytic bath which is provided with an anode, a cathode opposing the anode, and one or a plurality of diaphragms arranged between the electrodes, which are ion-selectively permeable and separate the electrolyte solution supplied so as to contact each electrode, and in which the dissolved cationic component is separated by electrophoresis by flowing a current between the electrodes while cyclicly supplying different kinds of electrolyte solutions into each space separated by the above mentioned diaphragm(s).

Regarding the production of the desired separated matter, it is not greatly influenced by variations in the mechanical conditions, such as the shape of the electrodes of the electrolytic bath or differences in the positioning between the electrodes. The factors controlling the desired properties of separation are the conditions which control the electrolyte components dissolved in the cathode chamber solution, the concentration of hydrogen ion exhibited by the solution and the temperature of the solution during operation, as well as maximum concentration of the separated matter dispersed in the cathode chamber solution.

In other words, by furnishing these conditions, it has become possible for the first time to discriminate between the soluble matter and the insoluble separated matter, despite the fact that the properties of the ion species of the mixed metals separated by migration differ, so as to produce and separate the insoluble separated matter, in response to the environment provided by the active oxidation-reduction reaction with the reducing hydrogen gas produced on the surface of the cathode and accompanying the exchange of electrons. Furthermore, with the insoluble separated matter, by combining factors for differentiation including differences in particle sizes, differences in specific gravity, and differences in dissolution rates or acid radicals which make dissolution possible, when an attempt is made at redissolving the insoluble separated matter, even if there are a large number of species of metal ion components dissolved in the mixed solution, a hitherto unknown, simple method of separation may be applied, and thus, a method for specific separation and purification, which is effective and has a wealth of applications, may be provided.

The ion species which is caused to migrate to the cathode surface by the electrolytic separation process involving migration, though it is only the result of a simple electrolytic reduction reaction on an electrode surface, has a major influence on the ion species coexisting around it, due to changes of the ion species in the solution to be electrolyzed on the electrode surface.

Also, the ion species which are caused to migrate to the negative electrode surface are susceptible to the influence of changes in the negative electrode surface and the environment around them, while they are is also largely influenced by side reaction phenomena caused by changes in the environment and energy conversions due to the exchange of electrons with the electrode surface.

In addition to the differences in the migrated ion species, the behavior of the above mentioned ion species within the cathode chamber solution differs greatly as a result of the combination of differences in the environment to which the cathode chamber solution is exposed and in the pH conditions exhibited by the cathode chamber solution. Also, if it is desired to utilize the differences in the properties of the dissolved ion species, it is important to determine whether the state of solution is maintained or whether they are in an undissolved state, and further, it is important to utilize the differences in the physical properties of the separated matter—for example, the difference in buoyancy due to particle size, specific gravity, shape, etc.— which is exhibited in an undissolved state. Considering these factors, by combining methods for the further discrimination of the separated matter, even if a plurality of ion species are mixed together in the initial object solution to be electrolyzed, the discrimination of each ion species is not completely impossible, and there is presented a high possibility of removing a given component from the complex.

That is, the novelty of the present invention is in that, conditions are found in which ion species which have migrated to the negative electrode surface are insolubilized and separated from the solution system as particles reduced to insoluble particle oxides or metallic particles, and the properties of the separated matter may be controlled.

The methods of separating the separated matter from the system are preferably combined for operation so that the temperature of the cathode chamber solution circulated to the cathode chamber is between 30° C. and 100° C., and the concentration of the separated matter produced and dispersed in the cathode chamber solution is maintained between 10 mgr/l and 20,000 mgr/l. Also, the current density supplied into the cathode from the outside for the electrolytic separation operation is preferably maintained within 0.5 $A/dm^2$ to 60 $A/dm^2$.

First, the mechanism of a chemical reaction which may be developed in the cathode chamber will be described below.

STEP 1) A metallic ion species separated by migration to the cathode chamber forms a $Me(OH)_2$ hydroxynium compound with $OH^-$ ion generated by electrolysis of water molecules on the surface of the cathode, and the reaction proceeds from a homogeneous aqueous system to a heterogeneous dispersion system.

This reaction definitely progresses, but if it is thought that the amount of metallic ion separated by migration is large enough to make the alkalinity insufficient, it is preferable to add sodium salts or potassium salts of organic acids, represented by sodium acetate and sodium citrate, or potassium salts, or inorganic bicarbonates.

The sodium salt of an organic acid which is added disappears in accompaniment with the decarboxylation due to decomposition of the organic acid radical, by the oxidation-reduction reaction of the metal ion which accompanies the effervescence of the steam on the cathode surface, automatically producing free NaOH. By this, an appropriate alkalinity of the solution system may be maintained, and it is possible to maintain the separation reaction in a stable state.

However, if NaOH is added to the cathode chamber solution at the beginning, the size of the particles of the resulting hydroxide will be large and the strength of association between the particles will be strong, and they will not finely disperse. Therefore, the oxidation of the dispersed particles in the following reaction are not uniform, and thus, unfavorable phenomena often result; for example, the viscous particles adhere to the electrode surface and to each side of the diaphragm, and supplying the required current induces a voltage increase.

STEP 2) By raising the water temperature of the water system in which the separated matter is dispersed, the oxidation of the separated matter is accelerated by vaporization at the interface of the separated matter and the contacted water, and this causes conversion of the hydroxide into a primary oxide.

STEP 3) The separated matter converted into oxides basically contacts with minute air bubbles consisting of reducing hydrogen produced on the cathode surface, and it is thought that reduction proceeds by this reductive chemical reaction, but if a meticulously furnished environment is not prepared, then the above mentioned reduction reaction does not proceed. Also, complicated chemical reactions are assumed to occur due to the exchange of electrons at the electrode surface, and if selection is not made of a very limited metallic ion species, then the desired chemical reaction will not proceed.

When prepared chemical substances are dissolved in the cathode chamber solution, electrolytes contacting the electrode surface are converted into substances possessing active chemical properties, by complicated chemical reactions occurring on the electrode surface, and the metal ion contacts with these reducing chemical substances and gradually changes to the equilibrized stable substances determined by the provided conditions, depending on the differences in properties of the various metal ion species. Here, the above mentioned metal ion species are in the form of oxides in view of their chemical formulas, but from the point of view of their ion valency as dissolved in the starting solution to be electrolyzed, they are changed into the form of reduced ion. Also, some ion species produced cannot progress beyond the hydroxides in the primary reaction.

However, even if the solution system exhibits acidity, if it coexists with reductive metal ion, then the metal hydroxide which is insolubilized by the alkalinity produced on the cathode surface changes to a stable oxide, thus maintaining a dispersed state.

In this reduction reaction, a catalytic initiator is required at the beginning to promote the reaction, and when a substance which fulfills this role is present, the supply source for a continuous supply of energy to reproduce the catalytic action consists of the electrons continuously supplied on the electrode surface. Also, it is judged that the conversion of electrolytes which accompanies this exchange of electrons mediates the progress of the coupled reduction reactions on the surface of the dispersion particles. If other species of electrolytes are added, as well as other substances, eg. hydrazine, to reinforce the reducing effect, then the result will be further reduction to metallic particles (provided nickel ion is present) through a more reduced oxide form.

The following are chemical reaction formulas for representative behavioral changes in each of the above steps.

Step 1) $Me^{2}+2OH^{-}\rightarrow Me(OH)_2$ (Equation 1)

Step 2) $2Me(OH)_2+O(H_2))\rightarrow Me_2O_3+3H_2O$ (Equation 2)

Step 3) $3Me_2O_3+H_2\rightarrow 2Me_3O_4+H_2)$ (Equation 3)

Of the equations shown here, the most important reaction is the one of Equation 3 shown in Step 3), and if this reaction is applied to a wider range of metal species, the reduction reaction does not proceed simply with the hydrogen air bubbles generated at the electrode surface, and thus, it has been impossible to progress beyond Step 1) with the conventional electrolysis. Judging also from this, without considerable adjustments, it is impossible for the reaction to proceed from Step 1) to Step 3) in the same electrolytic bath. Furthermore, it is desired from the point of practicality to selectively separate the separated matter which has progressed in a continuous manner to Step 3), and remove it from the circulation system, combining procedures which raise the yield of the system reaction.

Therefore, according to the present invention, the environment for the electrolytic process is set as described below.

i) An operating environment, that is, suitable conditions of circulation rate of the cathode chamber solution, temperature of the cathode chamber solution, etc., are maintained so that the electrolytic process is carried out in an electrolyte solution at as high a temperature as possible; a circulation line is provided to allow the electrolyte solution to contact with the outside atmosphere, thereby producing hydroxides dispersed in particles which are easily oxidized in the following step.

ii) Next, it is important to consider the combination of the selection of a chemical substance with a secondary catalytic function which efficiently develops the reaction in Step 3); the selection of electrolytes for ion dissociation which maintains a low electrical resistance in the electrode solution, and the reducing properties.

The most important basic point regarding the electrolytic substance mentioned here which exhibits reducing activity is generally the selection of the anion species. Regarding the selection of the anion species, for example, if a sulfuric ion is selected and its concentration ratio is over about 1/10 of the normal concentration of the dissolved salts, then the oxidation number cannot be increased above that of the primary oxide compound ($Fe_2O_3$) even with the simultaneous mixture of different anionic species. However, even with electrolytic separation solutions of the same composition, if a mixed solution of a sulfuric ion and a chloric ion is used in the composition of the cathode chamber solution, then oxidation is accelerated, and may even progress to oxidation to secondary oxides ($Fe_3O_4$).

The fact that the oxidation behavior differs greatly depending on the anion species is very important, and it indicates the possibility of causing the exhibiting of effective functions by combining anion species. Therefore, the dissolved electrolytes which make up the cathode chamber solution are more advantageously maintained in a combined composition rather than as a single composition, although with some substances the effect is observed even with a single composition, and these include chloric ions. However, with only a sulfuric ion, the process terminates at the stage of production of the hydroxides by the reaction in the above Equation 1, without proceeding to the oxidation reaction shown by the above Equation 2, and further progression of reducing reaction is practically nonexistent. This compares unfavorably with cases where two or three other anionic radicals are mixed in, from the point of view of reduction speed and yield, and therefore, to achieve the desired effect, in a practical sense, it is shown to be much more effective to mix together two or three anionic species.

Further, for the combination of mixed anionic species, ammonium ions, when further added, are without exception capable of converting the separated matter which is electrolyzed and migrated to the cathode chamber into separated matter having a more reduced chemical formula.

The compound which is added to the cathode chamber solution as a source of this ammonium ion does not have to be a substance which has already exhibited the cationic dissociation of ammonium when added, and may be a non-ion dissociating substance such as, for example, urea. That is, even in the case of non-ion dissociating substances such as urea, if the ion is dissociated during electrolytic reduction and thermal decomposition on the cathode surface, then the same effect is observed to occur. It was confirmed that this ammonium ion has, together with the coexisting anions radical, eg. sulfuric ion, chloric ion, etc., a catalytic action which accelerates the reduction reaction of the dispersion, and clearly when they are used together, they are very effective ion species.

It was described above that, due to the presence of the above mentioned ammonium ion, the reaction effectively proceeds to the oxidative action shown in Equation 3, but if a nitric ion is used in the reaction system, then the reaction invariably proceeds only to the compounds in the above Equation 2, and does not develop to Equation 3 or beyond.

Also, some anion which exhibit an effect similar to the effect of the above mentioned ammonium ion include chloric ions, carbonic ions and carboxylic ions, whose effects are considerable.

These anionic radicals are not all necessarily effective when used as the cathode chamber solution as single compositions, but even in single composition solutions, if the substance to be separated is iron ion, then triiron tetraoxide may be produced after separation.

However, in order to further improve the probability of reaction and the product yield, rather than a solution of the above salts alone, it is advantageous to mix 2–3 species of salts, represented by, for example, sulfuric ions and ammonium sulfate. Furthermore, it was confirmed that the growth of micelle crystals which form the foundational structure of the particles produced by electrolytic separation in the cathode chamber solution can also be controlled by mixing a number of different salts.

The above mentioned phenomenon may cause a problem of the possibility that chemical reactions similar to those seen in the cathode chamber which parallel the electrolytic process might occur if an electrolyte solution with the temperature conditions of a similar solution is mixed and reacted, even when not accompanied by an electrolytic process. However, in such a case, the reaction may possibly proceed to the above Equations 1 and 2, but will not proceed to Equation 3. That is, the reaction represented by the above Equations 1–3 is a special phenomenon observed only in the environment of an electrolytic process, and differs greatly from the properties exhibited only by substances produced in a neutralization precipitation reaction under heated conditions in the presence of ammonia. For example, even if some of the substances promote the reaction, the reaction efficiency and reaction rate differ greatly (the yield is small, the conversion rate is very slow). Therefore, also from the point of view of practical size of all of the equipment required, according to the present invention, the same conversion capacity may be achieved with a smaller-sized apparatus.

In addition, regarding the composition of the starting aqueous solution containing various metal ion species for carrying out the electrolytic separation process, if, for example, it contains alkaline earth metal ion, represented by magnesium, then the alkaline earth metal ion migrates to the cathode chamber solution end by the process of electrophoretic separation, and an insoluble separated matter is produced depending on the concentration of accumulation. In this case, when it was subjected to flotation separation with the other separated matter, then effluent separation became possible as it migrated to the top due to its light specific gravity, and after purification, the above mentioned insoluble separated matter was removed by compositional analysis of the separated matter.

Furthermore, manganese ion is only converted to a hydroxide in a cathode chamber solution, but when a separation procedure such as the one described above was applied, it could be removed by a method involving the combination of higher specific gravity particles such as the object oxides, etc., and compared to the composition ratio of the separated matter to the ratio of the raw water, the composition ratio was considerable improved.

Until now, we have described the behavior of production of separated matter in a system which exhibits alkalinity, generally kept at a pH value greater than 7, but if it is desired to further improve the rate of decrease of the composition of the separated matter by separating certain ion species from a plurality of metal ion species dissolved in raw water in the same manner, by applying the above mentioned electrolytic migratory separation procedure, then the solution system may be controlled to create an acidic environment exhibiting a pH value of less than 7, in combination with the above mentioned method, in the presence of an electrolyte exhibiting chemically reductive properties in the environment in which the above mentioned cathode chamber solution is used. Thus, by controlling the pH of the cathode chamber solution, some production of hydroxides from the ion species which have been separated and have migrated to the cathode chamber is observed on the cathode surface under acidic conditions, but the oxidation reaction of this separated matter cannot be immediately accelerated, and it again returns to a dissolved state by ionization due to the acidity exhibited by the cathode chamber solution system. Therefore, if ion species which are not easily maintained in the cathode chamber solution as a stable, insoluble separated matter are mixed with ion species which have abundant reactivity to form firm oxides which maintain their insoluble state even under such acidic conditions, then they may be separated simply by filtration of the separated matter in the cathode chamber.

If the electrolytic separation process is effected according to the prior art, with no particular consideration of the composition of the electrolytes dissolved in the cathode chamber solution, and particularly using sulfuric acid in a solution of sodium sulfate alone while controlling the system to exhibit a pH of about 3, and using an iron sulfate solution as the solution to be electrolyzed, then iron ions electrodeposited onto the surface of the negative electrode at 1–2 hours after initiation of the procedure, and the electrolysis voltage increased making it impossible to continue the normal electrolysis process.

However, if the electrolytic separation process is effected using a solution to be electrolyzed such as the one mentioned in the above experiment in the same manner, controlling the solution prepared by redissolution by adding ammonium chloride and sodium acetate to sodium sulfate to a pH of about 3 in the same manner under acidic conditions using sulfuric acid, then no such behavior is seen of electrodeposition of iron ions on the cathode surface as was seen in the single composition solution of sodium sulfate, and there is practically no change in the voltage values maintaining the operating current values, and a stable continuation of the electrolysis process became possible. Furthermore, the formation of reddish dispersed particles was observed in the cathode chamber solution as the electrolyzing time progressed, and an actual increase in the concentration was observed.

In addition, by controlling the cathode chamber solution so that it maintains an even lower pH value of about 2, the color had more redness than that exhibited by the separated substance when the pH value was controlled to about 3. Furthermore, when, conversely, the pH value exhibited by the cathode chamber solution was maintained even higher at about 4, a yellowish tinted dispersion was produced. By controlling in this manner the pH values exhibited by the cathode chamber solution (particularly in the case of iron ion, it was greatly influenced by the composition of electrolytes dissolved in the cathode chamber solution), it is possible to change the hue of color exhibited by the separated matter which is produced by separation in the cathode solution. Also, by varying the combined ion species and their mixing ratios, the range of variable color hues is widened. That is, by controlling the pH value of the cathode chamber solution, a separated substance of a desired hue may be obtained.

The reason for differing colors exhibited by separated matter in the cathode chamber solution which consist of identical ion species is concluded to be that absorbance wavelength bands differ depending on the particle sizes. A tendency was shown that a stronger acidic pH of the cathode chamber solution produced smaller particles by separation and a redder color, while a weaker one produced larger particles by separation and a blacker color.

The reason for which the separated matter can be produced without being dissolved even under acidic conditions, by controlling the pH values exhibited by the cathode chamber solution, is believed to be that when once the insoluble separated matter is produced by the difference in the ion species it is enveloped by a dense oxide film which cannot be easily spoiled, and the conditions for redissolution require a change to conditions of harsh acidity. As a result, until the conditions change to allow redissolution, the dissolved component and the undissolved, suspended or sedimented component may be easily separated.

Thus, according to the present invention, the electrolyte components dissolved in the cathode chamber solution and the controlling conditions such as the concentration of hydrogen ion exhibited by the solution may be adjusted, making it possible to discriminate between soluble substances and insoluble substances irrespective of the properties of the mixed metal ion species separated by migration, in response to the environment provided for the active oxidation-reduction reaction with reducing hydrogen gas produced at the negative electrode surface accompanying the exchange of electrons, and thus, a stable separated matter may be produced and separated.

EXAMPLES

Figure 1:
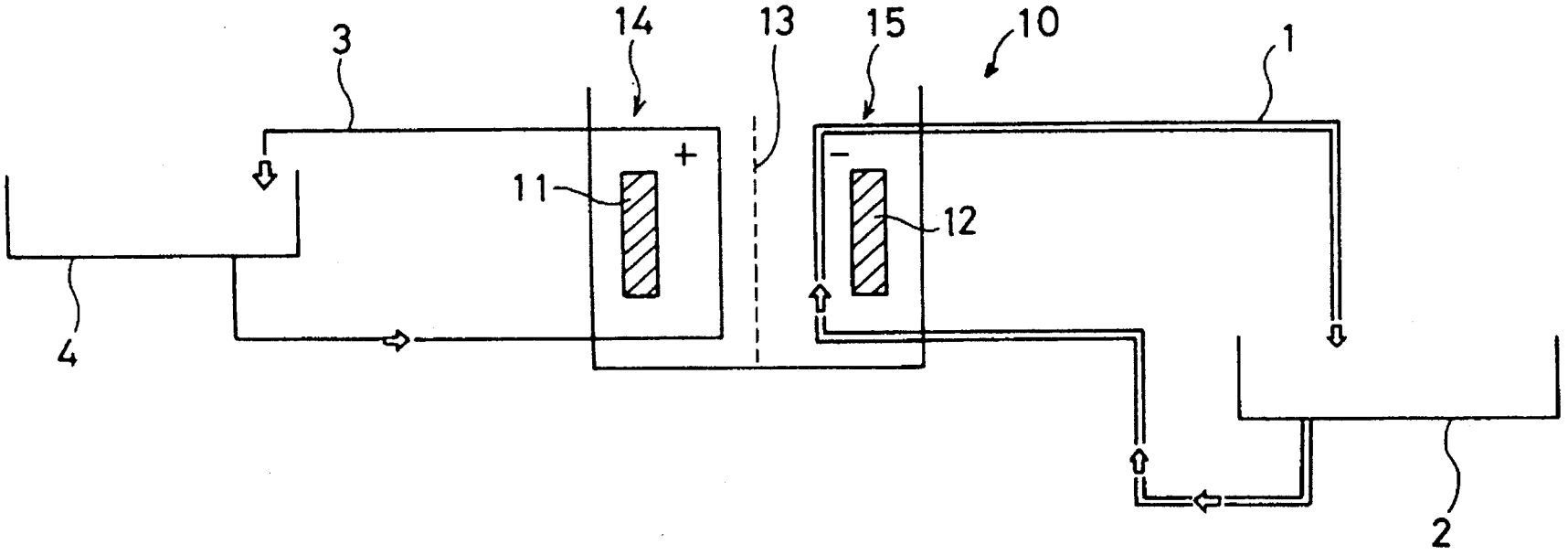
FIG. 1 shows an operating system including a first electrolytic bath according to an Example of the present invention.
Figure 2:
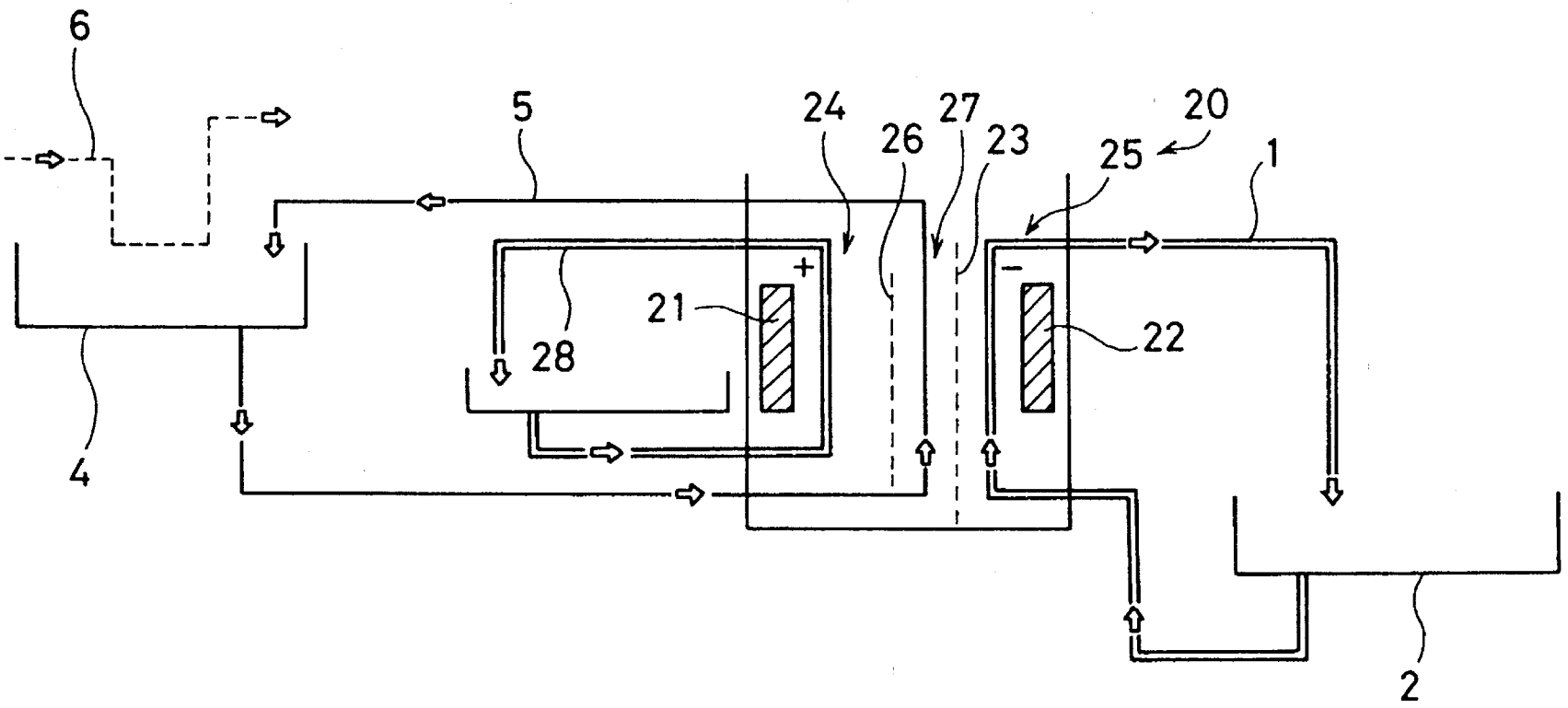
FIG. 2 shows an operating system including a second electrolytic bath according to an Example of the present invention.

FIGS. 1 and 2 show Examples according to the present invention, with their respective electrolytic baths and apparatuses simplified.

First, an explanation will be given regarding the 2 species of electrolytic baths used in the Examples.

One of the electrolytic baths (first electrolytic bath) 10 comprises a 750 mm diameter, 1200 mm tall, cylindrically shaped anode 11 with an iridium oxide coating on the electrode surface constructed as the outside wall. Also, a 710 mm diameter, 1200 mm tall, cylindrically shaped, stainless steel cathode 12 with a 1.5 mm nickel metal plate covering the electrode surface is constructed being arranged in a coaxial position with the anode 11 on the inside thereof. Here, the cathode 12 is supported by 6 conduction booth bars. Also, between both electrode plates 11, 12 is coaxially arranged a diaphragm 13 which is a superbly chemical-resistant, low-electrical resistant, cation-selective, cylindrical, single-sheet cation exchange membrane separating both electrode surfaces.

In addition, the object solution to be electrolyzed for the electrolytic migration separation procedure is designed to be supplied into a anode chamber 14 formed by the surface of the anode 11 and the diaphragm 13. Also, a cathode chamber solution of the electrolyte composition described below is supplied in a circulatory manner, with a device constructed on the exterior, from a cathode chamber solution circulation bath 2 into a cathode chamber 15 whose outer periphery is formed by the diaphragm 13 and in which the cathode 12 is provided. An anode solution 3 is circulated through an anode solution circulation bath 4 in the same manner as the cathode chamber solution 1. Here, each the amounts of each of the circulated solutions is set to 4–6 $m^3$/hr for both electrode solutions 1, 3.

A revolving drum-species filter (not shown) was provided in the cathode chamber solution circulation bath 2 to remove the separated matter which accumulated in the circulated cathode chamber solution 1, and the filtered water thereof was used as the wash for the accumulated separated matter held inside the revolving drum. Also, the concentrated wash was removed out, and this concentrate was further concentrated in a precipitation bath (not shown), the supernatant of which was circulated and used as the cathode chamber solution 1.

Furthermore, an indirect-species refrigeration unit (not shown) was provided in the circulation line of the cathode chamber solution 1 for control of the temperature of the circulating solution, and a relationship was observed between the controlled temperature, the properties of the separated matter from the cathode chamber solution 1 and the production conditions.

The current applied to both electrodes 11, 12 in the electrolytic bath 10 was set at 0.5–60 A/$dm^2$, and a direct current voltage capable of controlling the current to the necessary load for the experiment was supplied from a direct current generator to control the direct current voltage level.

The other electrolytic bath (second electrolytic bath) 20, FIG. 2, uses the same equipment as the first electrolytic bath 10, including electrode construction, solution circulating equipment, etc., but in addition to a diaphragm 23 separating an anode chamber 24 and a cathode chamber 25, a single sheet diaphragm 26 is also arranged opposite the cathode chamber 25, and thus both electrodes 21, 22 are opposed separated by a total of 2 diaphragms 23, 26.

Into a thus provided additional new isolated chamber (the space formed between both diaphragms) 27 was supplied the solution 5 to be electrolyzed which was of the same composition as the anode solution 3 provided to the anode chamber 14 in the above mentioned first electrolytic bath 10 in a circulatory manner. On the other hand, a solution 28 with electroconductive electrolytes dissolved therein is circulated to the anode chamber 24 in the second electrolytic bath 20 to protect the matter of the anode 21. That is, the electrolytic bath 20 differs from the first electrolytic bath in that it is divided into three chambers, with the object solution 5 to be electrolyzed which is to be separated by electrolytic migration is circulated into the compartment 27 between the diaphragms, while the electrolyte solution 28 for protection of the anode is circulated to the anode chamber 24.

The current density conditions applied in the second electrolytic bath 20 are the same as those in the case of operation of the first electrolytic bath 10.

Also, the circulated solution 5 to be electrolyzed is supplied by drawing a portion from the acid solution bath (anode solution circulation bath) 4, and a portion of the migrationally separated solution which is drawn from the compartment 27 of the electrolytic bath 20 is returned again to the acid solution bath 4.

An explanation will now be given regarding the solution 3 or 5 to be electrolyzed which is circulated to the anode chamber 14 or the compartment 27.

First, as a first solution to be electrolyzed, was used a solution which was drawn from a portion of a 10 $m^3$ solution bath acid-washing treatment of common stainless-species steel materials treated with acid-washing, containing 50 gr/l (1.79 N) of iron ion and 185 gr/l (3.77 N) of sulfate radicals. This first solution to be electrolyzed is used for the purpose of separating by electrolytic migration the mostly dissolved iron ion components contained in the solution intothe cathode chamber solution 1.

Furthermore, with the acid solution bath was additionally mixed a solution into which had been mixed and dissolved 7 gr/l (0.238 N) or nickel, 2 gr/l (0.072 N) or manganese, 6 gr/l (0.326 N), of chrome, 10 gr/l (0.326 N) of zinc, 0.6 gr/l (0.238 N) of calcium, 2.2 gr/l (0.238 N) of magnesium, or an inorganic or organic neutral salt, such as 30 gr/l (0.51 N) of NaCl, 28 gr/l (0.40 N) of $Na_2SO_4$, 70 gr/l (1.1 mol) of urea ($CO(NH_2)_2$), etc., and the resulting mixture was used as a second solution to be electrolyzed in the experiment.

The above values have been calculated on the assumption that the iron ion dissolved in the acid solution is a divalent ion, and chrome is dissolved as a trivalent ion.

As a third solution to be electrolyzed was used an acid solution prepared by adding, to the same composition solution as used for the above mentioned first solution to be electrolyzed comprising iron alone, with an ammonium compound with a buffering action against the steel material 6.

As an addition compound to be dissolved in the acid solution bath 4 for buffering action, either 20 gr/l (0.307 N) of ammonium sulfate or 50 gr/l (0.831 mol/l) of urea, was thermally dissolved therein.

Since the amount of iron dissolved in the acid solution bath increases, iron-lowering measures are necessary.

As a fourth solution to be electrolyzed was used a solution which was drawn from a portion of a 10 $m^3$ solution bath for acid-washing treatment of common stainless-species steel materials, containing 15 gr/l (0.80 N, $Fe^{3+}$) of iron ion, 31 gr/l (0.49 N) of nitric acid, and 10 gr/l (0.50 N) of hydrofluoric acid. This fourth solution to be electrolyzed is used for the purpose of separating by electrolytic migration the mostly dissolved iron ion components contained in the solution.

Furthermore, a solution containing 7 gr/l (0.238 N) of nickel, 2 gr/l (0.072 N) of manganese and 6 gr/l (0.346 N) of chrome added to the previous acid solution bath was used as a fifth solution to be electrolyzed.

The above values have been calculated on the assumption that the iron ion dissolved in the acid solution is a trivalent ion, and chrome is dissolved as a trivalent ion.

First, the first electrolytic bath 10 was used, and the above mentioned third solution to be electrolyzed was circulated thereinto to attempt the electrolysis process.

However, after 30 minutes have passed from initiation of the process, the voltage which was 3.5 Volts when a fixed current volume of 1 A/$dm^2$ was maintained steadily increased and reached 6.5 Volts after 2 hours.

Thereafter, when the electrolytic bath 10 was decomposed, a black, patchy sediment was found to have been deposited on the surface of the positive electrode 11 and to the diaphragm 13. It was determined that the composition of this deposited matter consisted mainly of iron oxide component. From these results, it was determined that, since this deposited matter covered the diaphragm 13 and the surface of the positive electrode 11, thus, reducing the electroconductive surface area, the voltage increased as mentioned above.

Furthermore, the cause of the phenomenon of the black, patchy sediment deposited on the surface of the positive electrode 11 and the diaphragm 13 was investigated. This cause was determined to be that the ammonium ion and urea-containing components underwent an oxidation reaction by the oxygen gas component produced on the surface of the positive electrode 11 and were converted to more reactive oxidized components, while the converted compounds in turn converted the iron ion components dissolved in the solution into insoluble iron oxide compounds, by a strong oxidizing process, even in an acidic solution which maintained a strong acidity, depositing them on the surface of the positive electrode 11 and the diaphragm 13.

From these results, it was determined that, when an acid solution is used which contains ammonium ion or organic urea-containing components, the second electrolytic bath 20 is appropriate to avoid direct contact of that species of acid solution with the surface of the positive electrode 11. That is, if the conditions are set so that the anode chamber 24 is isolated from the solution to be electrolyzed 5, and a larger amount of iron ion is not contained in the anode chamber 24, then an insoluble separated matter is not produced on the surface of the anode 21. In addition, a solution containing an electroconductor which maintains the solution composition is circulated into the anode chamber 24. Also, the solution to be electrolyzed 5 which contains ammonium ion and an organic urea-containing component is supplied for circulation into the compartment 27 between the two diaphragms. With this construction, variation in the operating voltage was eliminated, and it was possible to maintain the desired current in a stable manner.

This approach was also applied as a measure to protect the surface of the anode 21 when the fourth and fifth solutions to be electrolyzed, i.e., acid solutions containing chemicals, though capable of corroding the anode metal, had to be supplied to the anode chamber 24.

Example 1

Next, the first and second electrolytic baths 10, 20 were used, and the electrolytic separation process was effected circulating the first and second solutions to be electrolyzed. In this case, when attempting to remove by migrational separation the metal ion components accumulated in the solutions to be electrolyzed, the selection of the chemical to be used as the electrolyte dissolved in the circulated cathode chamber solution 1 is very important.

As one selection thereof, i) A solution in which was dissolved only 200 gr/l (2.87 N) of Glauber's salt ($Na_2SO_4$) was used as the cathode chamber solution 1. In this case, due to the hydrogen gas generated from the surface of the cathode 12, 22 and the alkalinity created by electrolytic decomposition of water molecules on the electrode surface, the pH exhibited by the circulated solution was on the weakly acidic side of about 5.0–6.5 prior to initiation, but as the electrolysis process began is increased to reach about 9.0–9.5. Also, when the pH of this circulated solution reached about 9.0–9.5, a blueish-black separated matter began to disperse in the cathode chamber solution 1. After 3 or 4 hours passed, the temperature of the circulated solution became over 40 ° C., and after more time passed, the temperature of the circulated solution rose to 70°–80° C., at which time the separated matter was taken from the cathode chamber solution 1 and put in a separatory funnel. When the washing procedure was effected to remove the salts adhering to the separated matter by adding fresh, purified water thereto, a lower layer of separated matter was produced while a gel-like separated matter was produced on the upper side, and therefore, the lower layer was removed to the outside, and fresh, purified water was further added to repeat the same washing procedure.

In this case, if the separated matter removed from the cathode chamber solution 1 is a completely oxidized metal oxide, then it quickly precipitates to the bottom and its volume cannot be changed even by repeating the washing procedure. However, if the above mentioned separated matter has not progressed beyond the hydroxide-producing reaction, then each time the washing procedure is repeated a brownish, gel-like, non-precipitous separated matter is produced. With this cathode chamber solution composition of only Glauber's salt ($Na_2SO_4$), initially, a gel-like, non-precipitous separated matter was produced, but by repeating the above mentioned washing procedure, the separated matter was elminated.

ii) Following the electrolysis procedure described in i) above, a cathode chamber solution 1 in which 100 gr/l (1.74 N) of sodium chloride (NaCl) was dissolved instead of the Glauber's salt ($Na_2SO_4$). In this case, a black, smooth, smaller separated matter was obtained which was not seen with the Glauber's salt ($Na_2SO_4$), and its behavior upon the same ashing procedure of the separated matter differed greatly from the above mentioned case of the cathode chamber solution composition of Glauber's salt ($Na_2SO_4$) alone, while no production of a gel-like substance was observed. Also, alignment of the separated matter was observed in an applied magnetic field, and the separated matter was confirmed to have been converted into a stable oxide which did not undergo hydrolysis with water alone.

iii) Furthermore, into the cathode chamber solution 1 described in i) above was additionally dissolved 50 gr/l (0.74 N) of sodium acetate. The product of the separated matter was particularly slow in the case where no sodium acetate was dissolved, but in this case, production of the separated matter was observed upon initiation of electrolysis, and continued as the electrolysis time progressed.

Also, when 50 gr/l (0.74 N) of sodium acetate was additionally dissolved into the cathode chamber solution 1 described in ii) above, the shade of color was very dark, and a separated matter was produced and separated in the stable lower layer even upon the washing procedure.

When, instead of the sodium acetate used here, other organic sodium salts, and sodium formate, sodium oxalate, sodium tartrate, etc. were used, the same effects were obtained.

Furthermore, even when sodium carbonate and sodium carboxylate were used, the same effects were observed. However, since the solubility of these chemicals is low, they are dispersed in a suspended state, and react in a non-uniform manner with the dispersed products of reaction with the metal ion in the solution, and there was also a greater residue of the dispersed matter of which a portion had not progressed beyond production of hydroxides. Judging from these results, an advantageous chemical may be said to be one which has a high solubility, does not decompose all at once, and which undergoes gradual oxidation decomposition on the electrode surface to suppress the reaction.

iv) Furthermore, when a chemical readily dissociable into ammonium ion, for example, ammonium sulfate ($(NH_3)_2SO_4$), is additionally dissolved into the anode composition containing Glauber's salt ($Na_2SO_4$) alone mentioned in i) above, to a concentration of 40 gr/l (0.61 N), the same effect as in iii) above was observed.

Furthermore, this chemical which is a substitute for the ammonium ion does not need to be one such as ammonium sulfate ($(NH_3)_2SO_4$) which is ionized immediately, and may be one such as urea ($CO(NH_2)_2$) which does not undergo ion dissociation. This species of substance was observed to be oxidized and ionized by complicated chemical reactions occurring on the surface of the cathode, and the same effects of change of the above mentioned separated matter due to oxidation was confirmed to be exhibited.

Also, if the ammonium ion supplied to the cathode chamber solution 1 is supplied in the form of a neutral salt, then it is advantageous to maintain the ammonium ion for a long period of time, but the resulting increase in the concentration of salt contained in the cathode chamber solution 1 causes a rise in viscosity of the solution, often creating an obstacle to separation process of the separated matter. Therefore, pouring in of ammonia water to maintain the pH exhibited by the circulated cathode chamber solution 1 is also thought to be effective in maintaining the properties of the separated matter.

On the other hand, a method in which caustic soda is added to the cathode chamber solution 1 from the beginning to maintain the alkalinity may be selected. However, in this case, since the alkalinity is too strong, the separated matter containing the metal ion species which electrolytically migrated to the cathode chamber 15, 25 forms hydrolium complexes once again, and as a result, because the viscosity increases and there is a change in dissolution, the tendency arises away from the formation of stable oxides, and the preferable controlled environment is lost.

v) As described in iii) and iv) above, a chemical which exhibits effects as an accelerator for the change of the separated matter to oxides in the cathode chamber solution 1 does not need to be introduced at the beginning. Since such chemicals have low osmotic pressure of salts upon dissolution and migrate to the cathode chamber 15, 25 with the hydrated ions through the diaphragms 13, 23, 26, the occurrence of the effect in the cathode chamber 15, 25 is somewhat slowed, but after some time passed the same effect is exhibited. Also, when urea was introduced into the solution to be electrolyzed, change of the separated matter at the cathode was observed, though the cathode chamber solution 1 was a solution of Glauber's salt alone.

vi) The chemicals described in i), ii) and iii) above are all sodium salts, but even when potassium salts were used in place of the sodium salts and the same phenomena and effects were observed, there was absolutely no change in the effects. Furthermore, when the hydrochlorate radical was replaced by the sulfuric ion in the salts which provided ammonium ion mentioned in iv) above, no problems were observed.

Furthermore, even when the salts mentioned in i)–iv) above were composed of mixtures of sulfuric ions and chloric ions, there was practically no different in the effects exhibited, and thus, it was confirmed that there is no problem with using mixed salts.

vii) In vi) above it was mentioned that the same effects are exhibited for any selection of electrolytic salts which exhibit the effects described in i)–iv) above, however, when nitric ions were present a peculiar behavior was shown. In particular, when the solution composition described in i) was changed from Glauber's salt to nitric acid, and the electrolysis process began under the conditions described in i), which produced a separated matter. The hue of the separated matter was black, and since it was an oxide, instead of the blue hydroxide as observed in i), it was removed to the outside, and repeatedly washed and separated as described in i), upon which there was no gel-like substance produced at first, but a precipitate separated to the bottom. However, as mentioned in ii), since the separated matter did not magnetically align when enveloped by a magnetic field, it was understood that the there was no oxidation to triiron tetraoxide. Furthermore, since the phenomenon of hydrolysis was observed for the above mentioned separated matter after allowing it to stand in water for 3–4 hours, it was confirmed that it had not been fully oxidized to stable oxides.

This phenomenon occurs because, when the conditions of the composition of the cathode chamber solution 1 are such that salts containing nitric ions are additionally dissolved therein, and the proportion of nitric ions in the entire salts dissolved in the solution (when expressed as equivalents of nitric ions with respect to the total equivalent concentration) exceeds about 20% of the cathode chamber solution composition, then the properties of the separated matter in the cathode chamber solution 1 is not susceptible to reaction for conversion into oxides on the surface of the cathode 12, 22. Therefore, it becomes necessary to draw out a portion of the cathode chamber solution 1 to examine the accumulation of the nitric ions.

Example 2

Next, the electrolysis process was carried out in order to obtain oxides with a component ratio with a higher content of iron from the second solution to be electrolyzed which contained iron ion as the main component, but also contained metal ion species and neutral salts.

When the first electrolytic bath 10 was used, the urea contained in the solution to be electrolyzed 3 was decomposed by the oxidation reaction on the surface of the positive electrode and ammonium ion and further the dissolved iron ion were converted into insoluble oxides, and thus, a stable, continuous process was unachievable.

On the other hand, when the second electrolytic bath 20 was used, a stable process was possible, as the migrationally separated matter was produced in the cathode chamber solution 1 which was circulated to the cathode chamber 25, and it was discovered that the physical constant of the precipitate of the separated matter could be varied by combined control of various factors such as the temperature of the solution circulated to the cathode chamber solution 1 and the applied current load calculated from the surface area of the electrode for the electrolysis process, the composition of the electrolytic solution making up the cathode chamber solution 1.

By using 150 gr/l (2.11 N) of Glauber's salt as the basic electrolyte of the electrolytes in the cathode chamber solution 1, and then further dissolving 50 gr/l (0.86 N) of sodium chloride and 50 gr/l (0.76 N) of ammonium sulfate thereinto, an environment was maintained in which the separated matter was converted into more stable oxide compounds. For the environment, the temperature of the cathode chamber solution was kept over 60° C., the pH of the cathode chamber solution was kept at about 9.5–10.0, and when the separated matter was further concentrated and removed out of the system, the temperature of the concentrate was further raised, while stirring was continued to promote the growth of the crystals.

When the precipitate was further separated, and an examination was made of the metal component composition ratio of the separated matter obtained after washing with a clear fluid, and also of the amount of residue of neutral salts included in the separated matter, no manganese component or alkaline earth metal was found among the metal components.

This is thought to be due to the fact that, in particular, in the separatory oxidation reaction system of iron ions in a cathode chamber solution 1, they have properties different from those for a reaction to oxides, and thus, they are not mixed in the separated matter.

Furthermore, it is thought that, since the specific gravity of the separated matter is low, the separated matter becomes fine, light and poorly precipitous on the water end of the upper layer side during the washing procedure, is washed away, and thus, does not fall under the category of sediment.

Also, manganese can be removed in the form of a hydroxide before it converts to an oxide, and further it may be discriminated on the basis of its different behavior in a magnetic field.

Furthermore, it was found that, due to the fact that the copresent inorganic salt undergoes ionic dissolution and is removed by dissolution by the washing process without undergoing occlusion into the separated matter, the proportion of the iron content was greatly increased with respect to the proportion thereof in the composition first observed in the solution to be electrolyzed, and even of other metal ion species, the proportion thereof was found to have been improved.

Example 3

The above mentioned second solution to be electrolyzed was used, which was a solution with iron as the main ingredient and to which a substance containing several species of metal ion species including nickel was additionally dissolved. After the electrolytes described with this cathode chamber solution composition were dissolved, the pH exhibited by the cathode chamber solution 1 was made acidic, and then controlled by adding sulfuric acid to while electrolysis continued. As a result, when the pH was 2.0, a clear, red, fine suspension was produced, and this suspension was taken out of the system, the sediment was washed, and the components were analyzed after the sedimented salt was removed. When the components which were included in the separated matter were detected, and compared with the composition ratio of the raw water, it was found that the screening and scouring process of the components observed in Example 2 had been further promoted, and also that the zinc and nickel components had been removed, and that the purity of the iron had increased.

Thus, it was confirmed that, depending on the pH of the cathode chamber solution 1, the separated matter of certain metal species, for example zinc ion, which had already migrated to the cathode chamber due to the differences of the ion species, dissolved at a pH value of<5.0, and an insoluble separated matter was not produced.

Also, it was confirmed that the separation of other metals, such as alkali metals and alkaline earth metals, could be done with particular ease and reliability.

However, it was also confirmed that, if there are no ion species present on the surface of the cathode 12, 22 to accelerate the reduction reaction, then the metal deposits on the surface of the cathode 12, 22, and it is difficult to continue a stable electrolytic process.

Example 4

As the solution to be electrolyzed 3, 5 was used as the solution additionally mixed with the second solution to be electrolyzed, that is, the second solution to be electrolyzed which contained no iron ion.

In this case, the cathode chamber solution 1 consisted of a salt of an organic acid added to a Glauber's salt solution, and a hydrazine solution in an equivalent corresponding to the amount of the migrated metal which was judged on the current which flowed during the electrolysis process, and the temperature of the cathode chamber solution 1 was controlled to remain at 70° C. or higher. Thus, there was produced a nickel metal powder in the cathode chamber solution 1, and since its specific gravity was greater than that of the iron oxides, it could be separated by flotation. Also, by this procedure, another metal ion, chrome ion was simultaneously separated in a form joined to the the nickel ion. In this case, the appropriate amount of hydrazine is 0.2–2.0 equivalents per equivalent of the metal ion separated by migration.

Other alkaline earth metals were oxidized only to hydroxides, and other neutral salts were separated by the difference in their solubilities.

Example 5

In cases where a negative ion (fluorine, ammonia) which is judged to have a very strong coordinate bond with the metal ion species (iron) is present in the solution to be etectrolyzed 3, 5, as in the above mentioned second, fourth and fifth solutions to be electrolyzed, if these solutions are neutralized, because of the strong coordinate bond between iron and the fluorine radical, the iron generally tends to become insoluble while keeping the coordinate bond. If an attempt is made to redissolve this iron, then fluorine gas is produced in the furnace and pollutes the metals in the furnace, creating a very troublesome problem.

However, it has been shown that if, as a measure to solve this problem, a sodium salt or ammonium salt which exhibits alkalinity makes up the composition of the cathode chamber solution 1, then the anion coordinated with the metal ion which has migrated through the diaphragm reacts immediately with the sodium and ammonium in the cathode chamber solution 1, forming a soluble neutral salt, and thus, the metal ion does not envelop fluorine ion, making possible the conversion to oxides.

In the same manner, chloric ion and ammonia cation also coordinate with metals, but in this species of electrolytic separation process, it was hypothesized that a considerable amount thereof would remain enveloped in the metal ion end when the metal is converted to oxides; however, there was no trace of this, and a neutral product resulted from washing of the separated matter.

We claim:

1. A method for operation of an electrolytic bath in an electrolytic cell comprising an anode electrode and a cathode electrode opposing the anode electrode; said method comprising:

a. providing two diaphragms arranged between said electrodes; said two diaphragms defining an intermediate chamber between said electrodes; a first one of said diaphragms and said cathode electrode defining a cathode chamber; a second one of said diaphragms and said anode electrode defining an anode chamber;

b. wherein said first diaphragm is a cation selectively permeable membrane;

c. circulating different kinds of electrolyte solutions respectively to the anode chamber, the cathode chamber, and the intermediate chamber, characterized in that the cathode chamber solution which is circulatorily supplied into the cathode chamber has a salt containing an ammonium ion and a sodium ion as cations, and a sulfuric ion as anion, and being free from any nitric ions, said ions functioning as electrolytes, for maintaining basic electrical conductivity of said cathode chamber solution;

d. maintaining the pH of the cathode chamber solution at 8.5 to 10.5;

e. circulating an electrolyte solution containing a divalent ferrous ion component to said intermediate chamber;

f. supplying electric current between the anode and the cathode while circulatorily supplying the different kinds of electrolyte solutions respectively into the anode, cathode, and intermediate chambers, causing any divalent ferrous ion component dissolved in the electrolyte solution circulatorily supplied into the intermediate chamber to be selectively electrophoresed toward the cathode;

g. contacting the divalent ferrous ion with the cathode chamber solution to produce triiron tetroxide ($Fe_3O_4$); and h. separating triiron tetroxide from said cathode chamber solution.

2. The method for the operation of an electrolytic bath according to claim 1, further including controlling hydrogen ion concentration in the cathode chamber solution by adding to the circulated cathode chamber solution constituents comprising a free acid selected from the group consisting of sulfuric acid, hydrochloric acid, and phosphoric acid, and a soluble free alkaline agent solution; and adjusting the addition of said added constituents to control the hydrogen ion concentration in the cathode chamber solution; and controlling the amount of the ferrous ion component separated by migration to the cathode chamber by said addition adjustment.

3. The method for the operation of an electrolytic bath according to claim 1, further comprising adding to the circulated cathode chamber solution, an organic chelating agent which selectively reacts with the divalent ferrous ion component separated by migration to the cathode chamber solution; and controlling the amount of the separated ferrous ion component by the amount of said added agent; and maintaining said separated divalent ferrous ion component in a soluble ionized state.

4. A method for operation of an electrolytic bath in an electrolytic cell comprising an anode electrode and a cathode electrode opposing the anode electrode; said method comprising:

a. providing two diaphragms arranged between said electrodes; said two diaphragms defining an intermediate chamber between said electrodes; a first one of said diaphragms and said cathode electrode defining a cathode chamber; a second one of said diaphragms and said anode electrode defining an anode chamber;

b. wherein said first diaphragm is a cation selectively permeable membrane;

c. circulating different kinds of electrolyte solutions respectively to the anode chamber, the cathode chamber, and the intermediate chamber, characterized in that the cathode chamber solution which is circulatorily supplied into the cathode chamber has a regulator which maintains alkalinity of the cathode chamber solution by decomposing itself in response to electrolysis, said regulator comprising at least one selected from the group consisting of an ammonium salt, a urea carbonate, and a carboxylate;

d. maintaining the pH of the cathode chamber solution at 8.5 to 10.5;

e. circulating an electrolyte solution containing a divalent ferrous ion component to said intermediate chamber;

f. supplying electric current between the anode and the cathode while circulatorily supplying the different kinds of electrolyte solutions respectively into the anode, cathode, and intermediate chambers, causing any divalent ferrous ion component dissolved in the electrolyte solution circulatorily supplied into the intermediate chamber to be selectively electrophoresed toward the cathode;

g. contacting the divalent ferrous ion with the cathode chamber solution to produce triiron tetroxide ($Fe_3O_4$); and h. separating triiron tetroxide from said cathode chamber solution.

5. The method for operation of an electrolytic bath according to claim 4, further comprising adding to the circulated cathode chamber solution constituents comprising a free-acid containing sulfuric acid and a soluble free alkaline agent solution; and adjusting the addition of said added constituents to control the pH of the cathode chamber solution; and controlling the amount of the metal ion components separated by migration to the cathode chamber by said addition adjustment; and maintaining said separated metal ion component in a solubilized state.

6. The method for the operation of an electrolytic bath according to claim 4, further comprising adding to the circulated cathode chamber solution, an organic chelating agent which selectively reacts with the divalent ferrous ion component separated by migration to the cathode chamber solution; and controlling the amount of the separated ferrous ion component by the amount of said added agent; and maintaining said separated divalent ferrous ion component in a soluble ionized state.

* * * * *